US010941502B2

(12) United States Patent
Sintoma et al.

(10) Patent No.: US 10,941,502 B2
(45) Date of Patent: Mar. 9, 2021

(54) ELECTROLYTIC PROCESS AND APPARATUS FOR THE SURFACE TREATMENT OF NON-FERROUS METALS

(71) Applicant: METAL PROTECTION LENOLI INC., Montreal (CA)

(72) Inventors: Onita Sintoma, Repentigny (CA); Ovidiu Crisan, Montreal (CA)

(73) Assignee: METAL PROTECTION LENOLI INC., Montreal (CA)

( * ) Notice: Subject to any disclaimer, the term of this patent is extended or adjusted under 35 U.S.C. 154(b) by 352 days.

(21) Appl. No.: 15/964,450

(22) Filed: Apr. 27, 2018

(65) Prior Publication Data

US 2018/0245231 A1 Aug. 30, 2018

Related U.S. Application Data

(63) Continuation-in-part of application No. PCT/CA2016/051241, filed on Oct. 27, 2016.

(Continued)

(51) Int. Cl.
*C25D 11/10* (2006.01)
*C25D 11/30* (2006.01)

(Continued)

(52) U.S. Cl.
CPC ..... *C25D 11/10* (2013.01); *C25D 11/024* (2013.01); *C25D 11/026* (2013.01); *C25D 11/16* (2013.01);

(Continued)

(58) Field of Classification Search
CPC ..... C25D 11/026; C25D 11/10; C25D 11/024
See application file for complete search history.

(56) References Cited

U.S. PATENT DOCUMENTS 3,171,797 A 3/1965 Otto et al.
3,755,093 A 8/1973 Suematsu (Continued)

FOREIGN PATENT DOCUMENTS

BG 110102 A 11/2009
EP 0324325 A1 7/1989

(Continued)

OTHER PUBLICATIONS (ISA/210) International Search Report of PCT/CA2016/051241 (dated May 4, 2017).

(Continued)

*Primary Examiner* — Brian W Cohen
(74) *Attorney, Agent, or Firm* — Damien Calvet; Gowling WLG (Canada) LLP

(57) ABSTRACT

An electrolytic process, an electrolytic solution and electrolytic assembly are disclosed, for anodizing in one main step non-ferrous metallic parts, or their alloys to form a uniform coating. The electrolytic solution is free of toxic or harmful chemicals. Examples of treatable metals include aluminum, cast aluminum, magnesium, hafnium, tantalum, titanium, vanadium, and zirconium. The treatment is a one-step process since the cleaning and coating of the nonferrous metals are performed in the same electrolytic cell or tank and solution, preferably using the same electrical device for both actions. No preliminary steps like degreasing, de-smutting or activation are needed due to the absence of toxic acids or salts in the process. The process is therefore eco-friendly, easy to perform and provides excellent results. The nonferrous metallic parts once coated can be used in the automotive or aircraft industries.

18 Claims, 11 Drawing Sheets

Related U.S. Application Data

(60) Provisional application No. 62/246,875, filed on Oct. 27, 2015.

(51) Int. Cl.

| | |
|---|---|
| ***C25D 17/12*** | (2006.01) |
| ***C25D 17/10*** | (2006.01) |
| ***C25D 11/26*** | (2006.01) |
| ***C25D 11/28*** | (2006.01) |
| ***C25D 11/02*** | (2006.01) |
| ***C25D 17/06*** | (2006.01) |
| ***C25D 11/34*** | (2006.01) |
| ***C25D 11/16*** | (2006.01) |
| ***C25D 11/24*** | (2006.01) |
| ***C25D 11/22*** | (2006.01) |

(52) U.S. Cl.

CPC ..... *C25D 11/26* (2013.01); *C25D 11/28* (2013.01); *C25D 11/30* (2013.01); *C25D 11/34* (2013.01); *C25D 17/06* (2013.01); *C25D 17/10* (2013.01); *C25D 17/12* (2013.01); *C25D 11/22* (2013.01); *C25D 11/243* (2013.01); *C25D 11/246* (2013.01)

(56) References Cited

U.S. PATENT DOCUMENTS

| | | | |
|---|---|---|---|
| 4,159,927 | A | 7/1979 | Bernard et al. |
| 4,221,640 | A | 9/1980 | Shibata et al. |
| 4,659,440 | A | 4/1987 | Hradcovsky |
| 4,668,347 | A | 5/1987 | Habermann et al. |
| 5,792,335 | A | 8/1998 | Barton |
| 6,280,598 | B1 | 8/2001 | Barton |
| 6,919,012 | B1 | 7/2005 | Bucar |
| 2002/0104761 | A1 | 8/2002 | Birss et al. |
| 2003/0070936 | A1 | 4/2003 | Dolan |
| 2004/0030152 | A1 | 2/2004 | Macculloch |
| 2004/0238368 | A1 | 12/2004 | Mawston |
| 2004/0238386 | A1 | 12/2004 | Mawston |
| 2012/0031765 | A1 | 2/2012 | Curran |
| 2013/0052352 | A1 | 2/2013 | Cano-Iranzo et al. |

FOREIGN PATENT DOCUMENTS

| | | | |
|---|---|---|---|
| EP | 0330722 | A1 | 9/1989 |
| EP | 1587348 | A1 | 10/2005 |
| EP | 1793019 | A2 | 6/2007 |
| EP | 2003218 | A1 | 12/2008 |
| EP | 2233614 | A1 | 9/2010 |
| IT | 1125973 | B | 5/1986 |
| RU | 110090 | U1 | 11/2001 |
| WO | 1988008046 | A1 | 10/1988 |
| WO | 9842892 | A1 | 10/1998 |
| WO | 0228838 | A2 | 4/2002 |
| WO | 2017070780 | A1 | 5/2017 |

OTHER PUBLICATIONS (ISA/237) Written Opinion of PCT/CA2016/051241 (dated May 4, 2017).

Extended European Search report for EP 16858533.9 (dated Apr. 2, 2019).

A

B

A

B

ELECTROLYTIC PROCESS AND APPARATUS FOR THE SURFACE TREATMENT OF NON-FERROUS METALS

CROSS-REFERENCE TO RELATED APPLICATIONS

The present patent application is a continuation-in-part of international application no. PCT/CA2016/051241 filed on Oct. 27, 2016, and which claims the benefits of priority of commonly assigned U.S. Patent Application No. 62/246,875, filed at the U.S. Trademark and Patent Office on Oct. 27, 2015, both entitled "Electrolytic process and apparatus for the surface treatment of non-ferrous metals" and the content of which being incorporated herein by reference.

FIELD OF THE INVENTION

The present invention belongs to the field of electrochemical process for the surface treatment of metals, in particular of non-ferrous metals.

BACKGROUND OF THE INVENTION

Anodizing (also spelled anodising, particularly in the UK, India and Australia) is an electrolytic passivation process used to increase the thickness of the natural oxide layer on the surface of metal parts.

The process is called anodizing because the part to be treated forms the anode electrode of an electrical circuit. Anodizing increases resistance to corrosion and wear, and provides better adhesion for paint primers and glues than does a bare metal. Anodic films can also be used for a number of cosmetic effects, either with thick porous coatings that can absorb dyes or with thin transparent coatings that add interference effects to reflected light.

Anodizing is also used to prevent galling of threaded components and to make dielectric films for electrolytic capacitors. Anodic films are most commonly applied to protect aluminum alloys, although processes also exist for titanium, magnesium, niobium, zirconium, hafnium, and tantalum.

Anodizing changes the microscopic texture of the surface and the crystal structure of the metal near the surface. Thick coatings are normally porous, so a sealing process is often needed to achieve corrosion resistance. Anodic films are generally much stronger and more adherent than most types of paint and metal plating, but also more brittle. This makes them less likely to crack and peel from aging and wear, but more susceptible to cracking from thermal stress.

It is not common that one unique treatment can be made suitable for a large range of metals and/or alloys different physically and chemically. There is a need for a multipurpose treatment by the fact that in many finishing shops, different metals are treated and it can be useful, cheaper and efficient to process different non-ferrous metals such as magnesium, aluminum, or titanium using the same layout in the factory.

Magnesium. Magnesium is a metal with physical properties quite similar to aluminum but its chemical properties are quite different. This is the reason why a conversion coating process used for aluminum when applied on magnesium may give bad results on a subsequent painting process. Magnesium is appreciated because it is light and easy to produce and form. It is the lightest metal used for structural applications as being 34% lighter than aluminum. Magnesium and its alloys, especially in cast items, are really sensitive to corrosion and require a surface treatment to ensure aesthetic aspect and functionality of the parts. The most common finishing surface treatment of magnesium and its alloys is painting, but to paint magnesium it is necessary to create a "conversion coating" on which a conventional paint (powder, wet or electrophoretic—e.g. Ecoat) can adhere. Such "conversion coating" can be produced just by dipping or by using an electrolytic process usually named "anodizing" because the coating is formed when the magnesium part acts as a positive pole (anode) of an electrolytic cell.

In the usual procedure, magnesium is treated performing the following steps:

1. Degreasing the magnesium using an alkaline solution;
2. Rinsing in tap water;
3. De-smutting/activation using an acid;
4. Rinsing in tap water;
5. Rinsing in deionized water;
6. Conversion coating (with or without using current);
7. Rinsing in tap water;
8. Rinsing in deionized water;
9. Drying;
10. Eventually painting or any further top coating (e.g. E-coat or PVD/CVD deposit) according to the final use of the part.

This type of anodizing process, known from the 1940s, presents the following two major problems:

1. The acid solution used in step #3 (acid de-smutting/activation) includes really toxic acids like nitric acid or hydrofluoric acid, and in some old formulations, even chromic acid now banned in a lot of applications, e.g., automobile; and
2. After the activation step, a powdery blackish patina frequently appears on the magnesium part, making unsatisfactory subsequent chemical conversion coating and final painting. Almost all the cast parts present this type of problem and only an accurate forged and extruded part can look clean and silvery after the activation.

More recent processes known under the acronyms of MAO (Micro Arc Oxidation) or PEO (Plasma Electrolytic Oxidation) have been introduced but even they are not exempt from the following problems. For instance, they produce an evident luminescence all around the parts under treatment due to sparks generated by an arcing phenomenon caused between the cathode and the anode (the magnesium part) by the high electric potential (voltage). Also, the solutions can include toxic compounds like fluorides, borates, and amines or instable salts like silicates or aluminate. Since the conductivity of those solutions is very low, and the applied current density to form the coating can be high reaching even 10-30 $A/dm^2$, the voltage at the end of the process can overcome 600V. In some cases, a combination of positive and negative current is obtained and $\Delta V$ can be around 1000 Volt. In practice, these types of processes are really expensive, frequently requiring complex and expensive electrical machines. Sometimes, a frequency variation up to 3000 Hz is obtained. Known anodizing on magnesium processes are expensive.

Anodizing has the advantage to be less sensitive to the alloys and production methods (even casting can give a good result), but the problem caused by the activation dipping can be a real obstacle.

There is thus a need for a new process that would allow:

1. activating the non-ferrous metallic parts, without the use of chemicals, in order to leave a patina on the parts;

2. Eliminating any toxic element from the anodizing solution, especially fluorides, borates, and primary or secondary amines;
3. Preparing a solution able to produce a coating at a lower current density and consequently without the formation of sparks. Indeed, when sparks are formed, a part of the applied current is dissipated as heat instead of being used for forming the coating; and
4. using a solution that must be non-toxic, having a long life and, when necessary, able to be recycled if any decontamination step is necessary after a long use.

Aluminum.

Aluminum has its own standardized processes for chemical conversion coatings and anodizing, but those processes frequently give unsuitable results for instance when high silicon containing alloys are treated or a very high hardness is required.

Originally, MAO and PEO have been claimed to achieve very hard coatings (e.g. 2000 HV—hardness in Vickers units) which are not possible with conventional processes using sulfuric acid at low temperature (max 900 HV). When treating high silicon containing alloys in the conventional way, a thick black powdery film remains on the aluminum parts before entering the chemical conversion solution or the anodizing tank. The presence of such coating makes any chemical conversion coating unsuitable to a subsequent painting step and the anodic layer anaesthetic and unsuitable for specific mechanical applications.

There is thus also a need for a new process for anodizing aluminum, allowing:

1. Avoiding the use of any preliminary alkaline chemical dipping by using a new solution as described herein;
2. Applying a current having density as low as possible in order to use a lower voltage to perform the anodizing process, saving as such energy and money; and
3. Providing an anodic coating on aluminum that can be "sealed" in any conventional way.

Cast Aluminum

Anodizing extruded aluminum in acidic medium (bathing $H_2SO_4$) is a well-known process, based on the synergy of the oxidizing effect of the acid and the electric current. Indeed, it is the in-depth transformation (from a few microns to tens of microns) of aluminum metal in alpha-aluminum oxide.

Naturally, aluminum, on its surface, presents a very thin layer (angstroms) of very compact oxide which prevents deeper oxidation providing to the aluminum a resistance to corrosion in acid and neutral conditions. Being also much less reactive than magnesium, in general, aluminum can be anodized in neutral or alkaline medium but needs a powerful oxidant, such as a strong acid or $H_2SO_4$. The acid is used to bring higher conductivity to the solution, and not for its oxidizing effect. The oxide layer is generated by the current only. The sulfate group ($SO_4^{2-}$) is not affected or hydrolyzed by the current. Citric or oxalic acid, and also hydrogen peroxide, bring reactive oxygen to the solution. Monoprotic acids such as nitric and hydrochloric cannot be used because they dissolve the nascent oxide layer. Phosphoric acid forms a very thin layer generally used for gluing.

Magnesium, in the contrary, being much more reactive, will dissolve in acidic conditions.

Apart from a low electrical conductivity, the presence of the silicon surface makes it impossible to develop a continuous oxide layer. Indeed, the layer that could however be obtained, presents discontinuities (deep crevasses representing unprotected attack zones) where silicon is present (the silicon is not anodized) which disqualify the corrosion resistance that the anodizing process is supposed to develop.

To address this aspect, thanks to the thermal effect of the spark anodizing, silicon present at the surface will combine with aluminum oxide to give Mullite ($3Al_2O_3*2SiO_2$). The Mullite is an aluminosilicate (ceramic) having a mechanical strength and resistance to corrosion near alpha $Al_2O_3$. It can be combined in the presence of phosphate with $Al_2O_3$ (formed in areas where the silicon is absent) so it is acceptable to think that a hybrid layer of these two elements will present interesting corrosion resistance.

The problem related to this is given by the Mullite formation temperature, or 1450° C., normally achievable by heat treatment in an oven and not in an aqueous solution. It is obvious that at this temperature, the alloy cannot withstand either since its melting temperature is below 600° C. It must be considered that the high temperature (close to the plasma temperature) developed in the electric spark (spark) will have a sufficient thermic effect for synthesizing Mullite in the alloy volume increment located at the workpiece surface.

The present invention overcomes these problems by combining a different electrolytic solution with a specific current density.

Titanium (and its Chemical Group Members: Zirconium, Hafnium and Tantalum).

Titanium and its family members have completely different properties compared to magnesium or aluminum (and their alloys). An electrolytic process can be used to "color" the titanium parts, for instance like a sort of coding for parts for medical applications (like prostheses or dentistry). In that case, the process is performed using essentially a strong acid, such as sulfuric acid. In general, a thick anodic coat is produced in sulfuric acid for generic applications or in phosphates for dentistry and prostheses. For structural or specific medical applications, an alkaline anodizing process may be required (e.g. according to ASM 2488), using for instance chemical treatment containing nitric and/or fluoride based products, similar to what was previously said above concerning magnesium activation.

By using an innovative process as described herein, the toxic dipping mentioned above can be avoided. Since the proposed treatment is alkaline, even the requirements of the above mentioned specification are fulfilled.

European patent application no. EP 1 793 019 A2 discloses an anodization process of non-ferrous metallic parts. However, EP 1 793 019 A2 does not teach the use of an electrolytic solution containing an organic acid and the resulting advantages disclosed herein after.

In conclusion, the drawbacks of the current known processes for treating non-ferrous metals are:

1. For magnesium or titanium, solutions containing toxic elements like nitric and/or fluorides/hydrofluoric acid are needed.
2. Cast aluminum during the treatments, prior to chemical conversion coating or anodizing, forms a blackish superficial patina which make the subsequent treatment unsuitable or of poor quality; and
3. MAO or PEO processes use toxic or unstable chemicals and in, any case, are too expensive for "low end" applications.

In these conditions, a significant improvement is achieved by the proposed treatment process in that it can avoid any preliminary dipping in toxic solutions, and the subsequent electrolytic process can be performed in a medium alkaline solution, at low current density and, consequently at lower voltage.

SUMMARY OF THE INVENTION

The invention is first directed to a process for the electrolytic treatment of non-ferrous metallic parts. The process comprises the step of anodizing the non-ferrous metallic parts by first applying a negative electric current to the non-ferrous metallic parts during a first given period of time and second applying a positive electric current during a second given period of time; while maintaining the metallic parts in an electrolytic cell comprising an alkaline electrolytic solution having a pH from 9 to 12, preferably from 10 to 12, more preferably from 10.5 to 11.5, and comprising at least one organic acid or salt thereof. The process is performed by using a continuous current or a variously shaped pulsating current provided via a rectifier operatively connected to a harmonic filter, the harmonic filter is an Advanced Universal Harmonic Filter (AUHF) providing reduced current distortion on a source side, the AUHF allowing reduced ripple voltage while improving purity of a DC voltage used in the process.

The invention is also directed to an electrolytic solution for use in a process for anodizing non-ferrous metallic parts, the electrolytic solution being an alkaline electrolytic solution having a pH from 9 to 12, preferably from 10 to 12, more preferably from 10.5 to 11.5, and comprising at least one organic acid.

The invention is also directed to an anodized non-ferrous metallic part obtained by the process as defined herein, wherein the anodized non-ferrous metallic part comprises a uniform anodized coating with a thickness up to about 20 μm. Preferably, the uniform anodized coating may comprise metallic salts, such as AgF, the uniform coating being then conductive to electricity.

The anodized non-ferrous metallic parts obtained by the process are preferably for use in the making of transport vehicles, such as, but not limited aircrafts, automobiles or trains.

The invention is also directed to an electrolytic assembly for anodizing non-ferrous metallic parts, comprising:

- an electrolytic cell configured to contain an electrolytic solution and to receive non-ferrous metallic parts for treatment, the cell having walls made or lined with a material non-current-conductive;
- at least one counter-electrode located in the cell along the walls thereof;
- a hanging system supported by a main support frame located over the electrolytic cell, the hanging system being configured to clamp, hang and fly the non-ferrous metallic parts over the electrolytic cell, and also to dive the metallic parts into the electrolytic cell in a way that the parts are hanged in the cell at a minimum secure distance away from the at least one counter-electrode; and
- an electrical power supply apparatus operatively connected to the counter-electrodes and the non-ferrous metallic parts, and configured to provide a negative current to the parts for a first period of time and a positive current to the parts for a second given period of time.

The subject of the present invention is first a process for the electrolytic treatment of non-ferrous metal materials, such as, in alphabetic order, aluminum, magnesium, hafnium, tantalum, titanium, vanadium, and zirconium, but such a list is just a non-restrictive indication.

Even less common metals like beryllium, scandium, yttrium, molybdenum or tungsten can be treated but they are of limited use.

The present invention allows the production of a surface coating which has both an aesthetic and a protective function. The electrolytic solution of the present invention is free of toxic or harmful elements. The non-ferrous metallic parts will be sent to the electrolytic step without any preliminary chemical treatment, in order to avoid the high toxicity typical of those treatments.

The present invention is a treatment to be applied to non-ferrous metals and their alloys providing the following improvements:

- no preliminary chemical treatment or activation of the mentioned non-ferrous metallic parts is necessary, eliminating as such the use of multiple tanks in the production assembly;
- the solutions according to the present invention are free from toxic elements; can be used for a long period of time and easily recycled when a cleaning step is necessary to eliminate any solid contamination, and easily maintained at their standard concentration ranges by simple and conventional analyses;
- an electrolytic multistep process is performed in the same tank and solution and, preferably, with the same electrical machine;
- the power consumption will be as low as possible, and in any case lower than any similar process known in the art (e.g., MAO or PEO); and
- the coating obtained by the process is suitable for any subsequent conventional sealing, painting or plating treatment according to the usual praxis and the main metal involved.

The advantage of using an organic acid in the electrolytic solution is to buffer said solution, leading to a more uniform structure of the layer due to a uniform and constant migration of the elements forming the layer to the surface of the metallic parts.

Other and further objects and advantages of the present invention will be better apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other objects, features and advantages of the invention will become more readily apparent from the following description, reference being made to the accompanying drawings in which.

DETAILED DESCRIPTION OF PREFERRED EMBODIMENTS

Although the invention is described in terms of specific illustrative embodiment(s), it is to be understood that the embodiment(s) described herein are by way of example only and that the scope of the invention is not intended to be limited thereby.

The present invention is based on the following main features:

- dipping the non-ferrous metallic part directly in an electrolytic cell or tank connected to an electrical power supply, preferably a special electrical rectifier as disclosed herein;
- monitoring the electric current applied to the metallic parts and counter-electrodes;
- the composition of the electrolytic solution; and
- optional post treatments.

Figure 9:
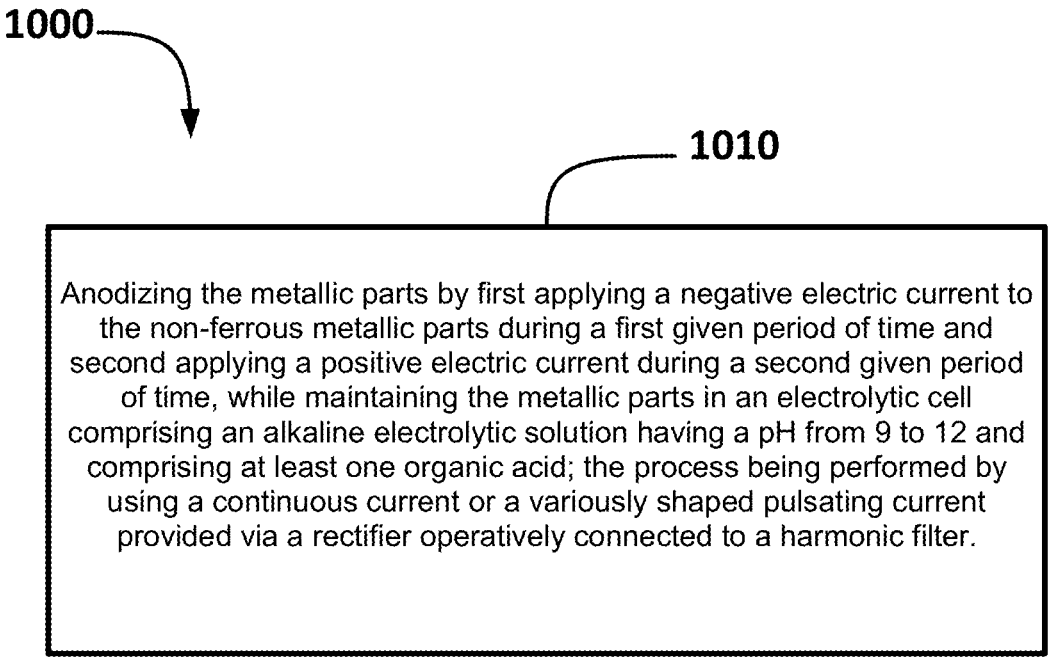
FIG. 9 is a flowchart illustrating the one-step electrolytic process for anodizing non-ferrous metallic parts, for instance magnesium, according to a preferred embodiment of the invention.

Therefore, the invention is first directed to a process for the electrolytic treatment of non-ferrous metallic parts. As illustrated on FIG. 9, the process (1000) comprises the main unique step of anodizing the metallic parts (1010). To do so, a first negative electric current is applied to the non-ferrous metallic parts during a first given period of time and followed by the application of a positive electric current during a second given period of time. During the electrochemical treatment, the non-ferrous metallic parts are maintained in an electrolytic cell comprising an alkaline electrolytic solution with a pH from 9 to 12, more preferably from 10 to 11.5. The composition also comprises at least one organic acid. More preferably, the process is free of chemical preliminary treatment before said electrolytic treatment, avoiding as such the use of highly toxic compounds. The process is performed by using continuous current or variously shaped pulsating current provided by a rectifier, more preferably provided by a pulse electrical rectifier with an electronic polarity reversal feature. The electrical power supply apparatus is connected to a harmonic filter such as the one disclosed herein.

According to a preferred embodiment, the non-ferrous metallic parts comprises aluminum, magnesium, hafnium, tantalum, titanium, vanadium, zirconium, beryllium, scandium, yttrium, molybdenum, tungsten, alloys thereof or combinations thereof.

According to a preferred embodiment, the first given period of time is selected according to the nature of the metal constituting the non-ferrous metallic parts under treatment and its final application. For instance, the negative current may be applied up to 10 minutes, more preferably up to 2 minutes. Also, the current density is selected according to the nature of the metal constituting the non-ferrous metallic parts under treatment and its final application. The negative current may have a current density of 0.5 to 5.0 A/dm$^2$, more preferably a density of 2.0 A/dm$^2$. The positive current may be applied from 30 seconds to 60 minutes, and the positive current may have a current density of 1 to 10 A/dm$^2$, more preferably the positive current has a current density of 2.0 A/dm$^2$.

According to a preferred embodiment, the positive current has a voltage from 200 to 650 Volts.

According to a preferred embodiment, the process according to the present invention may further comprise the step of cooling down the electrolytic solution in a way that the electrolytic solution is maintained at a temperature ranging between 5 and 40° C., more preferably between 15 and 20° C.

According to a preferred embodiment, the at least one organic acid, or its salts, is present in a concentration of from 0.1 g/l up to solubility, more preferably in a concentration of 10 to 20 g/l.

According to a preferred embodiment, the at least one organic acid, or its salts, have a number n of atoms of C from 1 to 20, linear or branched, and comprising from 0 to m hydroxyl groups, where m is a number from 0 to (n−1). For instance, the at least one organic acid can be carbonic acid, formic acid, acetic acid, hydroxyacetic acid, oxalic acid, citric acid, or ascorbic acid, or its salts obtained by the addition of alkali metals hydroxides or ammonium hydroxide in the solution.

According to a preferred embodiment, the pH is obtained by the addition in the solution of at least one alkali metal or ammonium hydroxide $NH_3OH$. Preferably, the said at least one alkali metal is lithium, sodium or potassium.

According to a preferred embodiment, the at least one alkali metal hydroxide is present in a concentration range from 10 to 100 g/l, more preferably in a concentration range from 30-50 g/l.

According to a preferred embodiment, the electrolytic solution further comprises phosphoric acid or its alkali metal salts, in a concentration up to 20 g/l.

According to a preferred embodiment, the electrolytic solution further comprises one or a mixture of tertiary alkanol amines in a concentration up to 75 g/l in the final solution.

According to a preferred embodiment, the electrolytic solution further comprises aluminum hydroxide or an alkaline metal aluminate, in a concentration up to solubility in the final solution.

According to a preferred embodiment, the electrolytic solution may further comprise polyalcohols in a concentration up to 50 g/l in the final solution.

As aforesaid, the present invention also concerns an electrolytic solution for use in a process for anodizing non-ferrous metallic parts, the electrolytic solution being an alkaline electrolytic solution having a pH from 8 to 11 and comprising at least one organic acid. The preferred embodiments regarding the electrolytic solution according to the present invention are as defined here above or in the examples. The non-ferrous metallic parts treated by the solution according to the present invention are, but not limited to, aluminum, magnesium, hafnium, tantalum, titanium, vanadium, zirconium, beryllium, scandium, yttrium, molybdenum, tungsten, alloys thereof or combinations thereof.

As aforesaid, the present invention also concerns anodized non-ferrous metallic parts obtained by the process as defined herein. The non-ferrous metallic parts obtained by the process comprises a uniform anodized coating with a thickness up to about 20 μm. Preferably, those parts once anodized, are particularly for use in the making of transport vehicles, such as but not limited to in the making of an aircraft, an automobile or a train.

Figure 1:
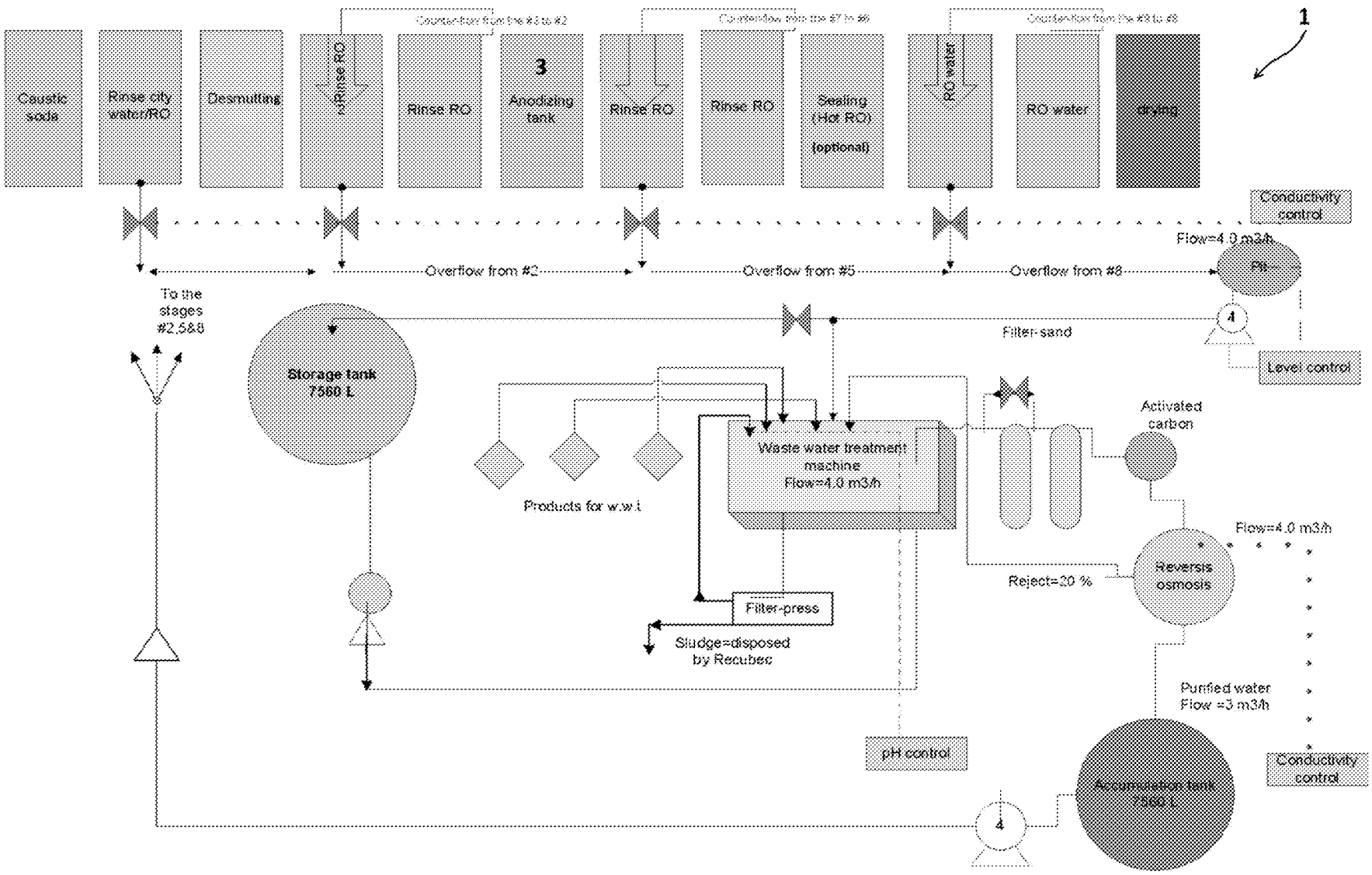
FIG. 1 illustrates the electrolytic assembly for anodizing non-ferrous metallic parts according to preferred embodiments of the invention.

As aforesaid, the present invention also concerns an electrolytic assembly for anodizing non-ferrous metallic parts. The set-up of the process tanks in the line is schematized in the flowchart of FIG. 1, whereas FIG. 6 presents pictures taken in the Applicant's plant.

Figure 6:
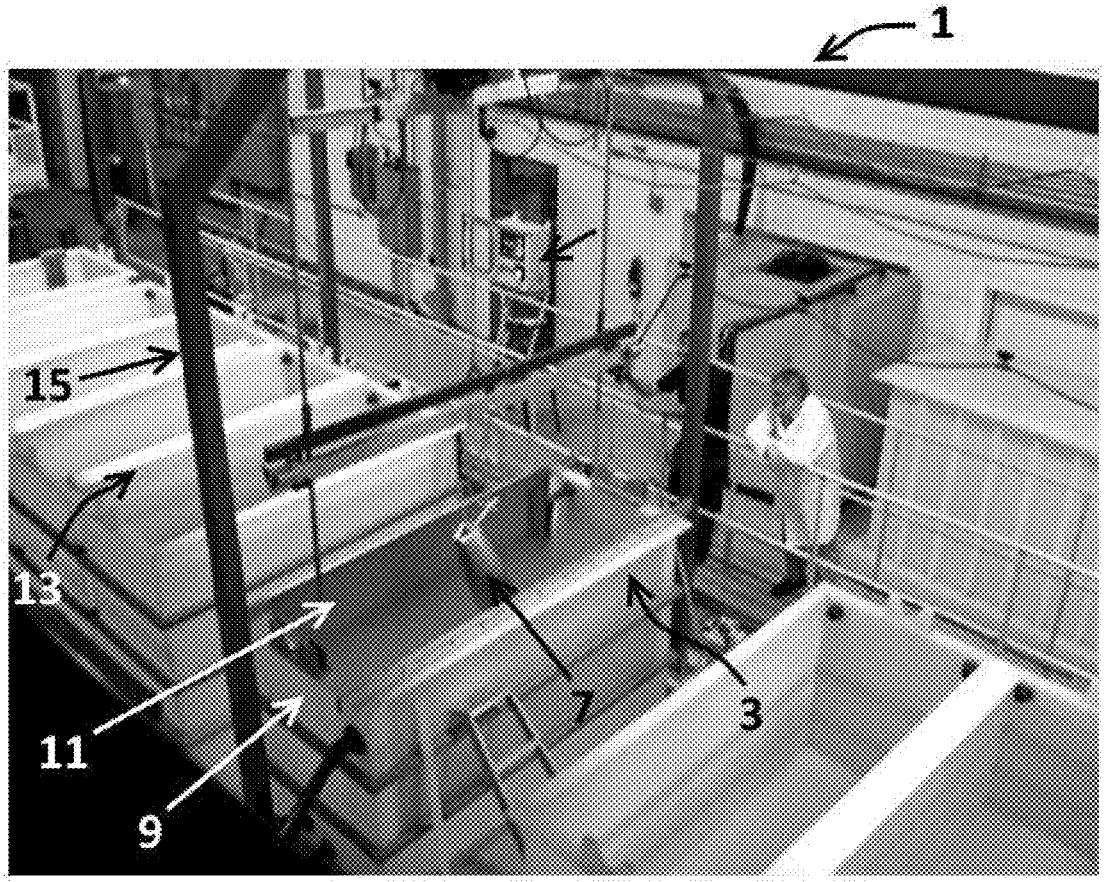
FIG. 6 are pictures of the electrolytic assembly according to a preferred embodiment of the invention.
Figure 6:
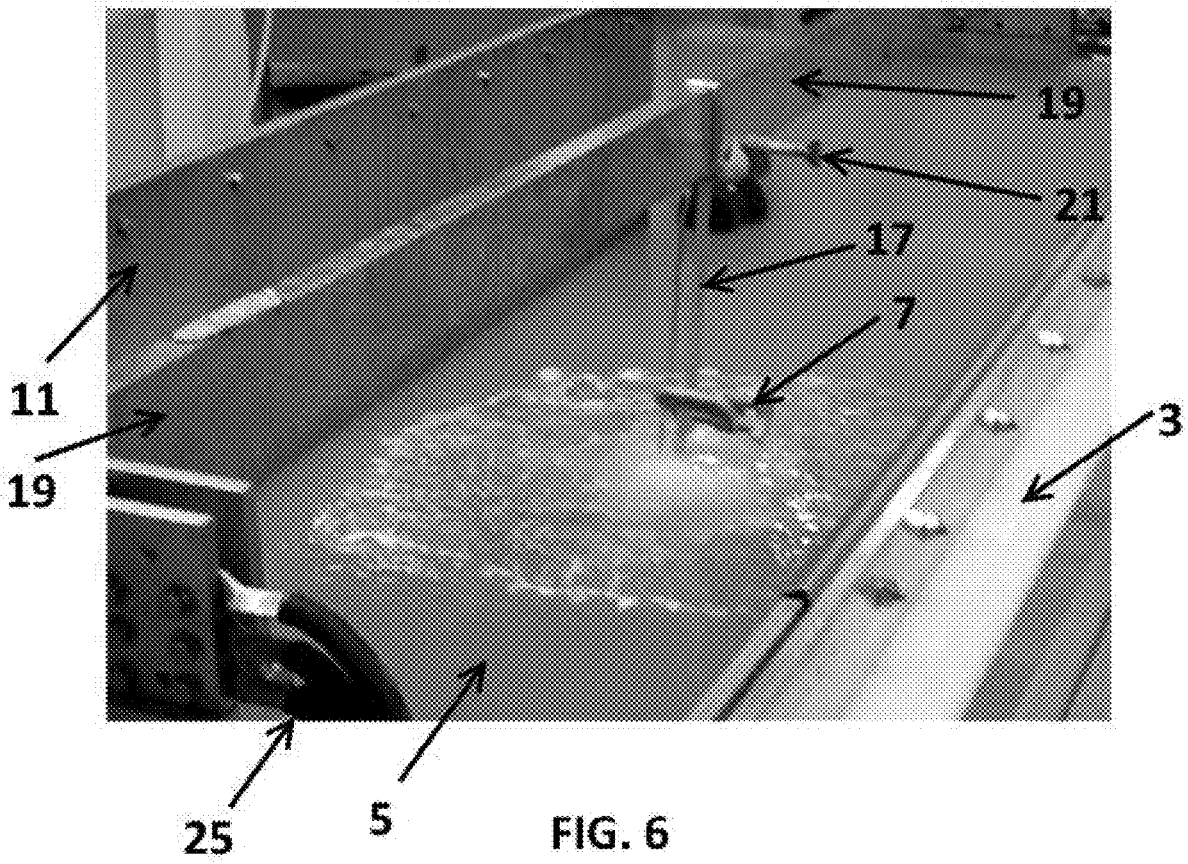

As shown on FIG. 6, the electrolytic assembly 1 according to the present invention first comprises an electrolytic cell 3 configured to contain an electrolytic solution 5 and to receive non-ferrous metallic parts 7 for treatment. The cell 3 may have walls 9 made or lined with of a material non-current-conductive. For instance, the cell's walls can be made of polypropylene (PP) or polyvinylchloride (PVC). Alternatively, the cell's walls can be made of steel or stainless steel lined, laminated or coated with a material non-conductive to electricity, such as polypropylene (PP) or polyvinylchloride (PVC). Other materials non-conductive to electricity known in the art of electrochemistry can be used.

The electrolytic assembly 1 according to the present invention also comprises at least one counter-electrode 11 located in the cell along the walls thereof. Preferably, the counter-electrodes are preferably placed on long sides of the cell's inner walls. The counter-electrodes may cover at least 75% of an inner surface of the cell's walls. The counter-electrodes 11 can be made of stainless steel, aluminum, titanium or other materials known in the art of electrochemistry for the making of electrodes.

The electrolytic assembly according to the present invention also comprises a hanging system 13 supported by a main support frame 15 located over the electrolytic cell 3. The main frame can be built on the floor of the plant building or can be part of the structure elements of the building.

The hanging system 13 is configured to clamp, hang and fly the non-ferrous metallic parts over the electrolytic cell, and also to dive the metallic parts into the electrolytic cell in a way that the non-ferrous parts are hanged in the cell at a minimum secure distance away from the at least one counter-electrode. The construction and movement of the mechanical elements allowing safely moving and dipping the non-ferrous metallic parts into the electrolytic cell or tank are known in the art of the manufacturing of anodized non-ferrous metallic parts. For instance, according to a preferred embodiment, the hanging system comprises hanging bars 17 spaced apart on a rail 19 and configured to move along the rail. Each hanging bar may comprise at least one jig or clamp 21 for attaching the non-ferrous metallic parts, the hanging bars and jigs being made of a current conductive material. For instance, the current conductive material may be aluminum, titanium or the like. The hanging system is preferably configured to hang the non-ferrous metallic parts in a middle section of the electrolytic cell as it can be seen on the bottom picture of FIG. 6, the minimum secure distance between the non-ferrous metallic parts and the counter-electrodes being from 10 to 50 cm.

The electrolytic assembly according to the present invention also comprises an electrical power supply apparatus 23 operatively connected to the counter-electrodes 11, for instance via electric cables 25, and the non-ferrous metallic parts. The electrical power supply apparatus is configured to provide a negative current to the parts for a first period of time and a positive current to the parts for a second given period of time.

According to a preferred embodiment, the electrical power supply apparatus 23 is an electrical rectifier, more preferably a pulse electrical rectifier, such as a 6-pulse rectifier disclosed herein.

According to a preferred embodiment, the electrical power supply can be operatively connected to a harmonic filter, such those known in the art, or in particular a LINEATOR™, AUHF (Mirus International Inc.)

According to a preferred embodiment, the electrical power supply apparatus is controlled by a programmable logic controller (PLC), a host computer or the like.

According to a preferred embodiment, the electrolytic assembly according to the present invention may further comprise a cooling system operatively connected to the electrolytic ell to maintain the electrolytic solution at a temperature ranging from 5 to 40° C.

EXAMPLES

The terminology used herein is in accordance with definitions set out below.

As used herein % or wt. % means weight % unless otherwise indicated. When used herein % refers to weight % as compared to the total weight percent of the phase or composition that is being discussed.

By "about", it is meant that the value of weight %, time, or temperature can vary within a certain range depending on the margin of error of the method or device used to evaluate such weight %, time, or temperature. A margin of error of 10% is generally accepted.

By "room temperature", it is meant the temperature where the compositions have been stored and prepared, or the process is performed. A room temperature of between about 15 and 25° C. is generally accepted.

Electrical Power Supply Apparatus and Type of Current:

The type of machine is available on the market or can be manufactured ad hoc, just reading the simple description detailed below.

TABLE 1

Example of current rectifier:
Current Rectifier: type NR with electronic polarity reversal

| | |
|---|---|
| Input: | 575 Vac, three phases - 60 Hz. |
| D.C. output: | 0 ÷ 575 Vdc; 0 ÷ 20 Adc |
| Duty: | continuous working at full load - class I (IEC 146-1-1) |
| Rectifier circuit: | 6 Pulses (dual three-phase bridge fully controlled) |
| Main transformer: | Dry type, Insulation class H<br>Aluminium windings.<br>Manufactured according to IEC 60076-1 and IEC 61558 standards |
| Ripple: | not higher than 5% (Rms) at full load |
| Input supply line current: | 3 × 14 Aac (14 kVA) approx. at full output load |
| Line current harmonics: | according to IEC 146-1-2 |
| Control: | electronic digital control, 0-100%, by means of microprocessor control card and SCR on secondary side<br>Constant voltage or constant current control (selectable) |
| Accuracy: | ±1% f.s. against load variation from 10% to 100% |
| Main breaker: | automatic type |
| Other Protections: | Max current continuous limiting device and pulse block;<br>Thyristor over temperature/transformer over temperature;<br>Fuses with trip indicator;<br>RC snubber circuits against overvoltage, parallel connected to SCR and to supply line |
| Equipped with: | N. 1 on/off main contactor |
| Cooling: | Forced air cooling (IP20) |
| Ambient conditions: | Indoor installation, safe and clean area non-corrosive atmosphere; Room temperature: min. 0° C., max +40° C. |
| Dimensions: | mm. 800 (w) × 800 (d) × 1800 (h) |

TABLE 1-continued

| Example of current rectifier: Current Rectifier: type NR with electronic polarity reversal | |
|---|---|
| Auxiliary circuit: | supply voltage: 110 Vac (internally generated) |
| Other connections: | terminals for external open gate limit switch |
| Control panel: | Remote digital control panel, with 10 m. cable, including: Digital DC voltmeter, digital DC ammeter; Start/stop buttons, function keyboard; Wide display for alarm and message visualization; Ramper process computer, type NR, to carry out automatically the process: Output polarities, output current values, ramp times, dwell times are entirely controlled by the ramper according to parameters memorized in the selected program. Up to 100 different programs can be memorized. Each program can include up to 10 steps; The treatment duration can be based on time or on preset number of Ah |
| Provided with: | Serial port (RS485 interface), for remote connection (Modbus RTU protocol) |

As aforesaid, the electrical power supply can be operatively connected to a harmonic filter, such as those known in the art, or in particular a harmonic filter type LINEATOR® AUHF (Mirus International Inc.). It is essentially a passive filter comprising an induction coil combined with a system of small capacitors. It allows for the reduction of all spurious harmonics of the main signal generated by non-linear loads of the system such as inverters or six pulses three phases' rectifiers.

Power System Harmonic Voltage distortion is a function of the Current Distortion of the load (the DC rectifier) and the impedance of the power system. To minimize their effects, high performance filtering of the harmonic currents typically produced by rectifier operation will reduce the non-fundamental current components flowing back through the power system impedance. Reducing Current Distortion on the source side using an Advanced Universal Harmonic Filter (AUHF) to feed the rectifier not only helps meet typical utility harmonic current limits, but reduces voltage ripple as seen on the DC bus as a result of the voltage waveform presented to the rectifier, ensuring greater purity of the DC voltage used in the process.

Figure 7:
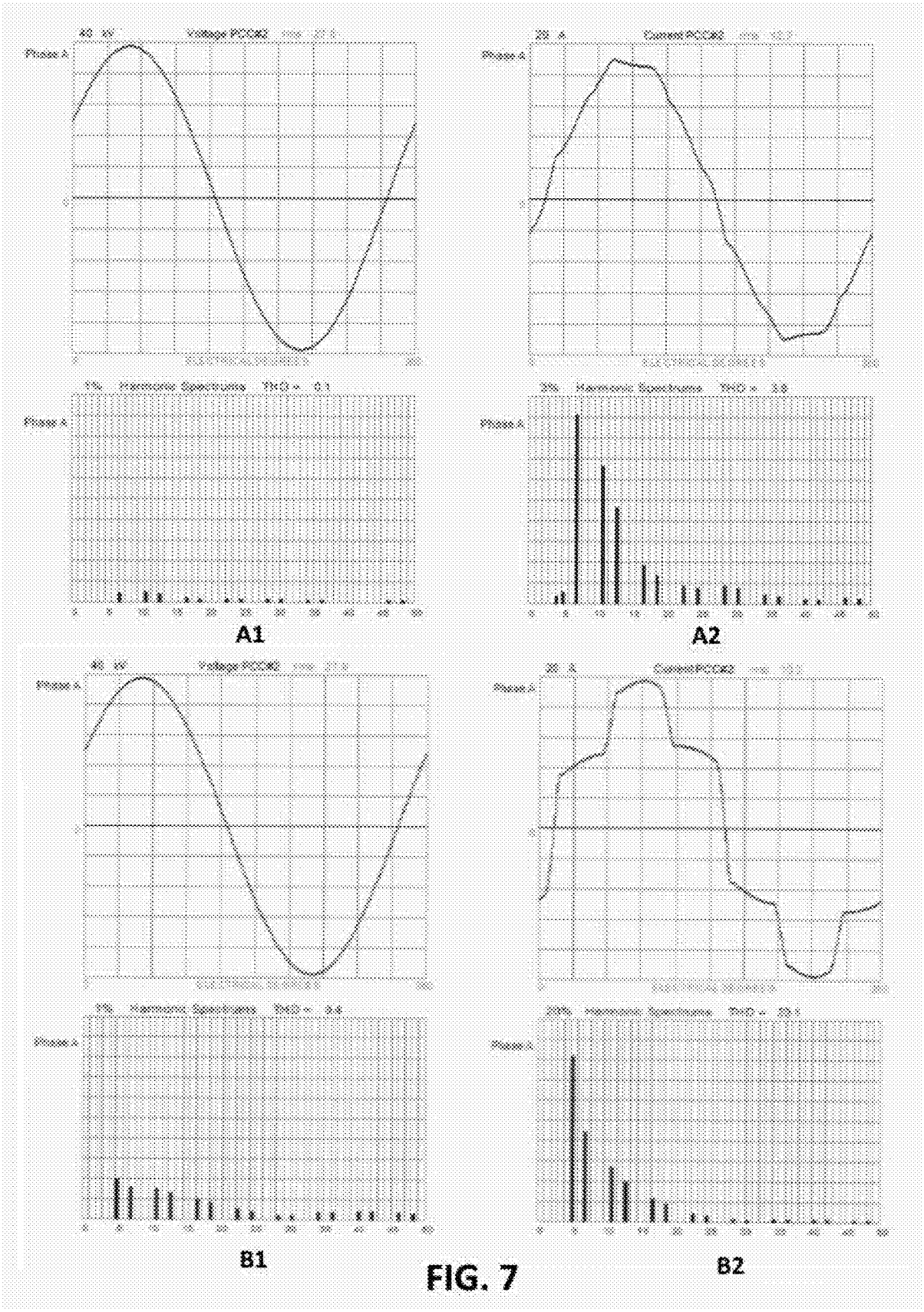
FIG. 7 shows current sinusoids and harmonic spectrum with (A1, A2) or without (B1, B2) a harmonic filter at 40 kV/20 A.
Figure 8:
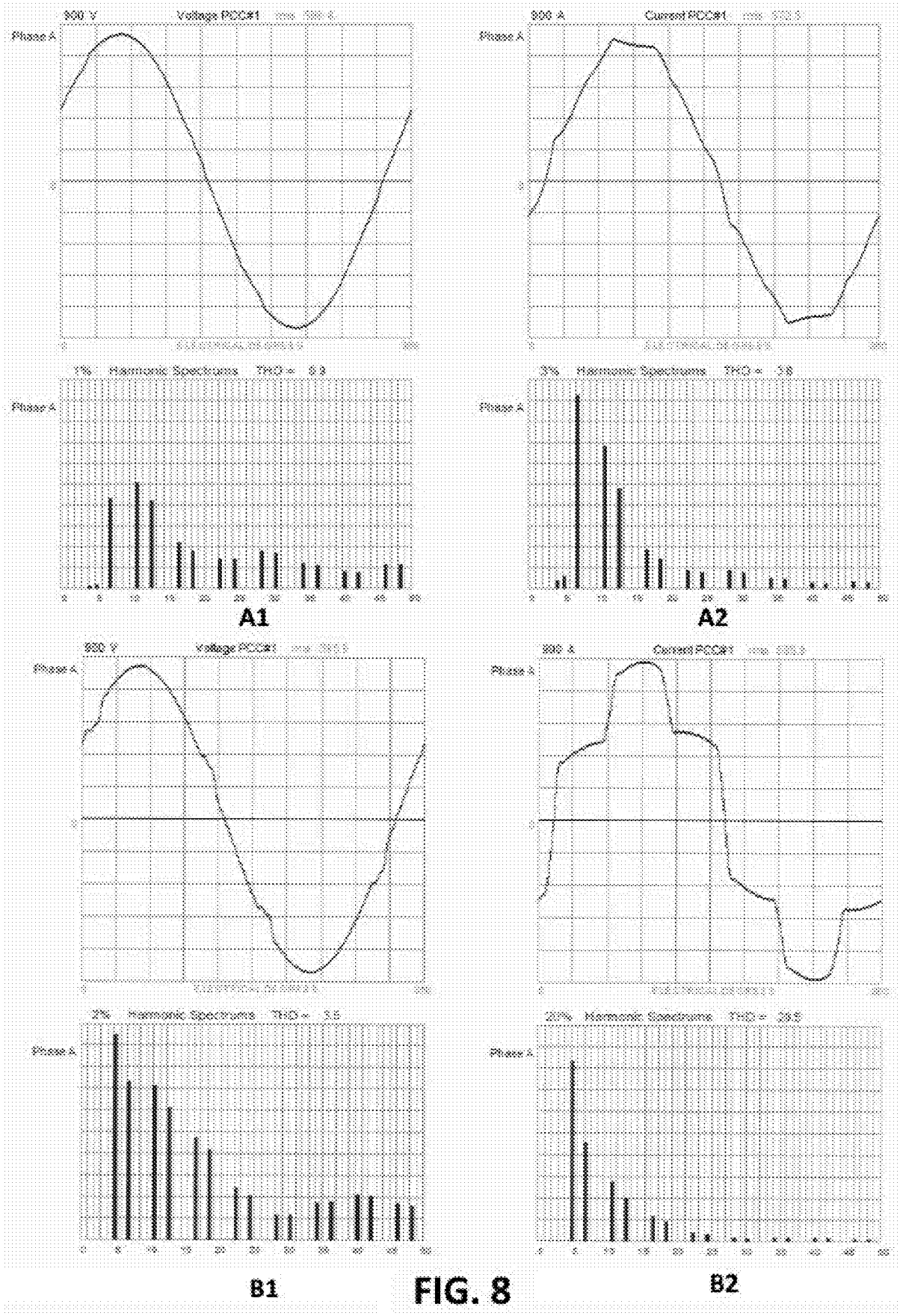
FIG. 8 shows current sinusoids and harmonic spectrum with (A1, A2) or without (B1, B2) a harmonic filter, at 900 V/900 A.

FIG. 7 shows current sinusoids and harmonic spectrum with (A1, A2) or without (B1, B2) a harmonic filter at 40 kV/20 A; whereas FIG. 8 shows current sinusoids and harmonic spectrum with (A1, A2) or without (B1, B2) a harmonic filter, at 900V/900 A. It is shown that the harmonic filter LINEATOR® improves the quality of electrical signals in the system by improving or reducing high frequency sinusoidal signals. The rate of current harmonic distortion is therefore reduced to comply with the requirements of electric current providers, such as Hydro-Quebec.

Using a harmonic filter improves the electrical signal sent to the electrodes and consequently, the resulting coating present a more uniform aspect and quality.

That electrical power supply is preferably managed by a PLC and able to supply a negative current for a given period of time, e.g., up to 10 minutes, preferably from 1 to 5 minutes, more preferably for about 2 min; and subsequently, to supply a positive current for enough time to form a coating layer with a thickness according to the real need. Indicatively, the time is ranging from 2 to 30 minutes, according to the desired coating thickness while depending on the applied current density.

Indeed, the anodization time is directly proportional to the resulting coating thickness, e.g., preferably 5-25 micrometers, more preferably 20 microns; and inversely proportional to the current density, e.g. preferably 1-10 A/dm$^2$, more preferably 2 A/dm$^2$. In practice, a preferable positive current is applied for 15 minutes at 2 A/dm$^2$ to produce a coating of about 20 microns, which is generally considered as the best suggested coating for any subsequent treatment of surface finishing.

As aforesaid, the electrolytic cell or tank for industrial production should be in polypropylene or PVC or simply in steel lined with a nonconductive material like, e.g., polypropylene or PVC, more preferably PVC.

The non-ferrous parts to be treated are placed in the middle of the tank, usually in the length direction, clamped on suitable jigs or racks connected to a main support. The bar with the parts is connected to the positive pole of the electrical supply (made negative, only during the first step of the process). The flying bar and all the jigs and racks are preferably in aluminum.

The counter electrodes (or cathodes when negatives) are placed on the long sides of the tank/cell and are preferably made in stainless steel or aluminum and should preferably cover 75% of the long side walls of the tank/cell.

The length and the depth of the tank will depend on the size and the daily production of the parts. The width should be fixed in order to ensure a distance between parts and counter electrodes ranging preferably from 10 to 50 cm. Too narrow distances could produce an electrical arcing with burning and/or melting of the parts. A too wide distance will need a higher voltage to be applied to ensure the set current density. Stainless steel or aluminum are the preferred metals for the counter electrodes/cathodes.

If we assume to use a suitable power supply/electrical machine managed by a main PLC, or a host computer when the process is included in an industrial plant, a non-limitative indication of the supplied currents can be detailed as in Table 1 below.

It is to be understood that if processed in the same solutions and with the same electrical parameters, the behaviour of the single metals can be different. In practice, with aluminum and some of its cast alloys the yield of the current (or the "coating ratio), i.e. the layer thickness produced by the same current, can be lower if compared with magnesium or titanium. With aluminum part of the current is lost as heat because sparks are necessary to maintain the conductivity of the layer allowing its increase.

TABLE 2

Example of supplied current, for a layer of about 20 micrometers (μm)

| Metal | Negative phase | | Positive phase | |
|---|---|---|---|---|
| Magnesium, (all its alloys and type of product) | Ramp time<br>Current density<br>Dwell time | 30 sec.<br>2 A/dm$^2$<br>2 min. | Ramp time<br>Current density<br>Dwell time<br>Estim. Final Voltage | 60 sec.<br>1-2 A/dm$^2$<br>15 min.<br>350 Volt |
| Aluminum (extruded, rolled, forged parts or low Si/Cu castings) | Ramp time<br>Current density<br>Dwell time | 30 sec.<br>2 A/dm$^2$<br>2 min. | Ramp time<br>Current density<br>Dwell time<br>Estimated Final Voltage | 120 sec.<br>3 A/dm$^2$<br>45 min.<br>500 Volt |
| Aluminum (High Si and/or Cu castings) | Ramp time<br>Current density<br>Dwell time | 30 sec.<br>2 A/dm$^2$<br>2 min. | Ramp time<br>Current density<br>Dwell time<br>Estim. Final Voltage | 120 sec.<br>6 A/dm$^2$<br>45 min.<br>650 Volt |
| Titanium, (all its alloys | Ramp time<br>Current density | 30 sec.<br>2 A/dm$^2$ | Ramp time<br>Current density | 120 sec.<br>3 A/dm$^2$ |

TABLE 2-continued

| Example of supplied current, for a layer of about 20 micrometers (μm) | | | | |
|---|---|---|---|---|
| Metal | Negative phase | | Positive phase | |
| and type of product) | Dwell time | 2 min. | Dwell time<br>Estim. Final Voltage | 25 min.<br>200 Volt |

Comments on Table 2:

All the pieces or parts can be treated directly by the electrolytic process. If an iron-media blasting step has been used to eliminate flashes or anti-stick/release agent used in the casting process it is advisable to repeat the blasting using glass, zirconia or alumina beads to eliminate any trace of iron residual from the surfaces of the parts. The presence of iron could alter the normal behaviour of the applied currents. Corrosion pits eventually present on the surfaces of cast magnesium or aluminum parts are not an obstacle to a correct result. When pits are really evident, a blasting step with nonferrous media can be advisable. Only in case of burned lubricating oils (e.g., in some forming of forging processes) a hot conventional alkaline degreaser could be necessary to clean the surfaces.

A negative current phase on the parts has the function to clean the surfaces and eliminate any "extraneous" parts like residuals of previous treatment, like machining or blasting. During the negative phase, a strong hydrogen production occurs on the surfaces producing their "activation" making them reactive to the next treatment.

All the non-ferrous metal alloys, subject of the present invention, are insoluble (or very slightly soluble) when processed in solutions as described herein, and when connected to a positive pole of a direct current supply, a dense layer is formed on their surfaces. The thickness of the layer is a function of the duration of the process, at a fixed current density. The voltage will increase autonomously with the time to maintain the pre-set current density with the increase of the resistance of the increasing layer. When the voltage reaches about 250 Volts, the formation of sparks from counter electrode (cathode) to the parts (anode) occurs. In some cases, sparks cannot be avoided because they are necessary to maintain the conductivity of the process. With some high silicon and copper containing aluminum alloys, a higher current density is necessary to ensure the film formation. There is a basic rule especially when processing low quality alloys: when with the treatment time passing the voltage remains too low (e.g. 20-30 Volt) and not increasing progressively, it is necessary to increase the pre-set current density to force the film formation just evidenced by the voltage increase. For magnesium alloys, the film formation follows the Faraday's law with a direct proportionality between the supplied current and the thickness of the layer. This proportion is better respected if the process can be managed below the discharge/spark voltage. With aluminum that is not always possible and the coating ratio is far from the theoretical values, because part of the electrical power is consumed as heat.

Lower current densities and spark-free processes reduce the treatment cost and ensure a better aesthetic surface finishing. The formed films look matte, opaque and white or whitish in color. Their aspect can find application in various fields because aesthetic and attractive.

Concerning the type of current to use, a negative current has been chosen for the cleaning step and a simple positive current for the phase producing the coating layer. The use of an alternative current during the anodizing step, and similarly a negative part in some way included during the positive step, has been avoided because no film can be formed during any negative current portion added to a standard positive current.

The Solution, Composition and Parameters:

Basic Indicative Data:

1. The solution will be preferably maintained at a temperature of 5 to 40° C. (preferably 15-20° C.);
2. The process can be highly exothermic and a reliable cooling system can eventually be necessary;
3. Air and/or a mechanical agitation by pumping is suggested, especially when complex shaped parts are treated. It is necessary to avoid gas bubbles and/or heat trapped in cavities, with the risk of spots or burnings;
4. A filter pump is suggested;
5. A fume suction and cleaning are suggested;
6. Due to the high current involved, for an industrial use of the process, an automatic plant with all the safety prescription is suggested;
7. According to the specific chosen composition, a dosing system of the main reagents can be used;
8. With the proposed composition, a recovery system and recycle of the solution can be applied; and
9. In any case, the solution can be eliminated just using the normal procedure for non-toxic waste water.

Just as an example, when the metal is magnesium or one of its alloys the preferable treatment time can be indicated as 5-15 minutes, according to the thickness of the layer to produce. The current density can range from 0.5 to 25 A/dm$^2$ (preferably 2.0 A/dm$^2$).

Composition of the Solutions:

An indicative solution can be structured as follows:

An organic acid, or a mixture of acids, containing from 1 to n atoms of carbon C, can be used for the making of the electrolyte, excluding only the aryl acids because of their toxicity due to the presence of a benzene ring. There is no particular limitation to define n, if not the solubility of the singles species in the final solution. No particular limitations for the type of alkyl chain (e.g.: linear or branched); even chains with double or triple bonds can be considered. The presence of hydroxyl groups or other substituents can be considered. Non limitative examples of such acids, in casual order, could be: carbonic, formic acetic, hydroxy-acetic, oxalic, citric, ascorbic etc. Each acid can be used singularly or in mixture (preferably alone or coupled with another one, for simplicity's sake). The concentration single acid or the mixture can range from 0.1 to 50 g/l (preferably 10-20 g/l).

The pH is regulated in the range of 9-12 by using single alkalis or a mixture of them in concentrations of 10-100 g/l (preferably 30-50 g/l). The alkalizing agents can be potassium sodium, lithium or ammonium hydroxides. An excess of alkalis is never detrimental. The acids as listed above can be substituted in total or partly by their alkaline metal salts or ammonium salts. It is preferable to use acids plus alkalis instead of the respective salts because the process is performed in an excess of alkalis.

An optional addition of any form of phosphates from 0 to 20 g/l can be positive to smooth the aspect of the coating especially when dealing with magnesium or aluminum.

An optional addition of a tertiary alkanolamine from 0 to 75 g/l can have a positive effect in the step 1 of the electrolytic process (cleaning and activation). A typical example is trietanolamine that can be suggested especially when treating magnesium or aluminum.

An optional addition of polyalcohols can bring benefits in a concentration from 0 to 50 g/l.

An optional addition of a metallic salt, such as, but not limited to, silver or cobalt salts brings conductivity to the coating layer. For instance, 2 g/l of AgF is added to the solution.

All the optional ingredients can be added together, but the preferred suggestion is to add each of them according to the real need and the type of metal to treat. In practice, only if treating magnesium and aluminum a better care is necessary in the formulation of the solution.

Other components like hydrogen peroxide or other persalts like perphosphates or persulfates can bring some benefit but their management in an industrial solution could be difficult.

The electrolytic solution is preferably free of the following harmful compounds because of their toxicity:

Chromates or any chromium compounds;

Borates or any boron containing compounds;

Fluorides or any fluorinated compounds;

Nitrates; and/or

Primary or secondary amines.

Composition Anod-SweetMag:

$C_6H_8O_7$ (Citric Acid): 0.5-2 g/l; preferably 0.7 g/l;

$H_3PO_4$: 10-30 g/l, preferably 15-20 g/l, more preferably 18 g/l;

Triethanolamine (TEA): 30-70 g/l, preferably 45-55 g/l, more preferably 50 g/l;

$NH_4OH$: 25-70 g/l, preferably 35-60 g/l, more preferably 50 g/l

City water for the initial charge.

Electrolytic Baths for Aluminum 2024-5052-7075 (Aerospace):

Composition A:

Organic acid (e.g. Citric acid or Oxalic acid): 0.5-2 g/l; preferably 0.7 g/l;

$NH_4V_2O_3$: 0.1-3.0 g/l, preferably 0.5-3.0 g/l, more preferably 1.0 g/l;

$H_3PO_4$: 10-20 g/l, preferably 10-15 g/l, more preferably 15 g/l;

$NH_4OH$: 25-70 g/l, preferably 35-60 g/l, more preferably 50 g/l;

TEA: 30-70 g/l, preferably 45-55 g/l, more preferably 45 g/l;

City water for the initial charge.

Composition B:

Organic acid (e.g. Citric acid or Oxalic acid): 0.5-2 g/l; preferably 0.7 g/l;

$(NH_4)_6Mo_7O_{24}$: 1-10 g/l preferably 3-5.0 g/l, more preferably 4.0 g/l;

$H_3PO_4$: 10-20 g/l; preferably 10-15 g/l, more preferably 15 g/l;

$NH_4OH$: 25-70 g/l, preferably 35-60 g/l, more preferably 50 g/l;

TEA: 30-70 g/l, preferably 45-55 g/l, more preferably 45 g/l; and

City water for the initial charge.

Composition C:

$NH_4V_2O_3$: 0.1-3.0 g/l, preferably 0.5-3.0 g/l, more preferably 1.0 g/l;

$C_6H_8O_7$ (Citric Acid): 10-20 g/l preferably 10-15 g/l, more preferably 15 g/l;

$NH_4OH$: 25-70 g/l, preferably 35-60 g/l, more preferably 50 g/l;

TEA: 30-70 g/l, preferably 45-55 g/l, more preferably 45 g/l;

City water for the initial charge.

Composition D:

$(NH_4)_6Mo_7O_{24}$: 1-10 g/l, preferably 3-5.0 g/l; more preferably 4.0 g/l;

$C_6H_8O_7$ (Citric Acid): 10-20 g/l preferably 10-15 g/l, more preferably 15 g/l;

$NH_4OH$: 25-70 g/l, preferably 35-60 g/l, more preferably 50 g/l;

TEA: 30-70 g/l, preferably 45-55 g/l, more preferably 45 g/l.

TABLE 3

Coating thickness:

| | Sample Anod Sweetmag | Anodization time (Min.) | Coating thickness (μm) (*) Side 1 | Coating thickness (μm) (*) Side 2 |
|---|---|---|---|---|
| 1 | Mg ZE41A-1 | 5 | 5, 5, 5, 5, 4 | 5, 5, 5, 5, 5 |
| 2 | Mg ZE41A-2 | 5 | 6, 5, 5, 5, 5 | 5, 5, 6, 6, 6 |
| 3 | Mg ZE41A-3 | 5 | 6, 6, 5, 5, 5 | 5, 5, 5, 5, 6 |
| 4 | Mg ZE41A-4 | 5 | 5, 5, 5, 5, 5 | 5, 5, 5, 5, 5 |
| 5 | Mg ZE41A-1 | 7 | 8, 8, 7 ,8, 8 | 7, 8, 8, 8, 8 |
| 6 | Mg ZE41A-2 | 7 | 9, 9, 8, 8, 9 | 8, 8, 9, 8, 9 |
| 7 | Mg ZE41A-3 | 7 | 9, 8, 8, 8, 9 | 8, 9, 8, 9, 9 |
| 8 | Mg ZE41A-1 | 10 | 10, 10, 10, 11, 10 | 11, 11, 10, 11, 10 |
| 9 | Mg ZE41A-2 | 10 | 10, 10, 10, 10, 10 | 10, 11, 11, 10, 10 |
| 10 | Mg ZE41A-3 | 10 | 10, 11, 10, 11, 10 | 11, 10, 10, 10, 11 |
| 11 | Al 5052-1 | 7 | 4, 4, 4, 3, 4 | 4, 4, 3, 4, 4 |
| 12 | Al 5052-2 | 7 | 4, 3, 3, 3, 4 | 3, 3, 4, 4, 4 |
| 13 | Al 5052-3 | 7 | 4, 4, 4, 4, 4 | 4, 4, 3, 3, 4 |
| 14 | Al 2021-1 | 7 | 5, 4, 5, 4, 4 | 5, 4, 5, 5, 5 |
| 15 | Al 2021-2 | 7 | 4, 4, 5, 5, 5 | 4, 4, 4, 4, 5 |

(*) Thickness measurements were determined using an Olympus PME3 metallurgical microscope at a magnification of 2000 times.

Measurements of the Resistance of the Treated Metallic Parts:

Chemical composition of Elektron® 43 alloy (ASTM alloy designation WE43C):

Yttrium: 3.7-4.3%

Rare Earths: 2.3-3.5%

Zirconium: 0.2% min

Magnesium: Balance.

Sample plate measuring approximately (155 mm×55 mm×15 mm) of Elektron® 43 alloy was coated using the following process:

Step 1: Inspect the surface of the panels for cleaning ability, and photograph the panels;

Step 2: Calibrate the Eddy current device on uncoated surface by using ASTM B244;

Step 3: Measure the surface and calculate the time and current amps needed to apply 0.0008-0.0010 inch or 0.020-0.025 mm coating thickness;

Step 4: Attach the panels on the rack with Duraclamps type 476T;

Step 5: Immerse panels into the anodizing tank (Room temperature);

Step 6: Introduce the data and start the rectifier computer

Step 7: Clean (negative current) and then anodize (positive current) the panels for 20 minutes (at Room temperature);

Step 8: Remove the panels and place in a tank containing water at room temperature for 0.25 minute maximum (first rinse);

Step 9: Remove the parts from the first rinse tank and place them in a second rinse tank for 0.25 minute maximum (second rinse);

Step 10: Remove the parts from the second rinse tank and remove the panels from the rack;

Step 11: Additionally, rinse the panels with ambient deionized (DI) water for 0.5 minute;

Step 12: Dry the panels with compressed air for 3 minutes;

Step 13: Inspect the parts' surfaces for possible defects and residue; and

Step 14: Measure the coating thickness by using Eddy current instrument. Results: 20 microns (average).

The paint coating system consists of a black polyester type layer of approximately 15-40 μm in thickness on an anodized surface of about 20 μm.

The coating has a low gloss finish and is specified with good adhesion properties; the polyester paint coat requires curing for 7 minutes at 204° C. as outlined in Table 4 below.

TABLE 4

| Technical data: | | | |
|---|---|---|---|
| System | Color | Appearance | Gloss |
| Polyester | Black | Santex | Visually low |
| Properties | | | |
| Specific gravity | | Coverage | |
| About 1.35 | | 142 ft/lb/1 mil | |
| Hardness | | Impact | |
| H-2H (ASTM D3363) | | 120 lb. direct - 120 lb reverse (ASTM D2794) | |
| Salt Spray | | Humidity | |
| 1,000 hours - less than 1/16' creepage over phosphate treated test panels (ASTM B 117) | | 1,000 hours - no blistering over phosphate treated test panels (ASTM D 2247) | |
| Curing instructions | | Conical mandrel | |
| 7 minutes at 400° F. (204° C.) or 15 minutes at 350° F. (177° C.) (metal temperature) | | 0.25 inches (ASTM D522) | |
| FEATURES | | | |
| Good adhesion; Good mar resistance Good corner penetration Good physical & mechanical properties Good spraying properties Outdoor durable (Meet or exceed A.A.M.A. 2603-98) Recommended film thickness: 1.5-4 mils. Maximum recommended storage temperature: 80° F. (27° C.) | | | |

The Elektron® 43 alloy plate was subjected to a 20 minute anodizing treatment with the solution approximately at 13-14° C.; to achieve a coating thickness of 0.020-0.025 mm. A three step cleaning method was used following the anodizing treatment where the plate was rinsed in water for 15 seconds at room temperature in stage 1 and 2 followed by rinsing in de-ionised water for 30 seconds in stage 3; the panels were dried using compressed air.

After 2000 hours of salt spray testing there was no apparent damage along the scribe marks (See FIG. 2) but only slight corrosion initiation at the centre. No lifting has occurred, however a rippled appearance and texture is observed across the coating. The reference sample was measured with a corrosion rate of 21 mpy (mils per year) after 2000 hours in salt spray environment.

Experimental:

The sample was subjected to ASTM B117-11 salt spray test, where a mist of 5% salt solution by mass is atomised in a chamber. The sample was exposed to the spray for intervals of 500, 1000, 1500 and 2000 hours. At each interval the sample was inspected and evaluated for surface condition.

The sample was scribed diagonally across the length with a polycrystalline type diamond tipped scribe. A reference sample of Elektron® 43 alloy was placed alongside the sample coated using the system according to the invention. A 15 mm slice was cut through the scribe marks for analysis on Scanning Electron Microscope (SEM) to observe the coating adherence to magnesium metal surface.

Figure 2:
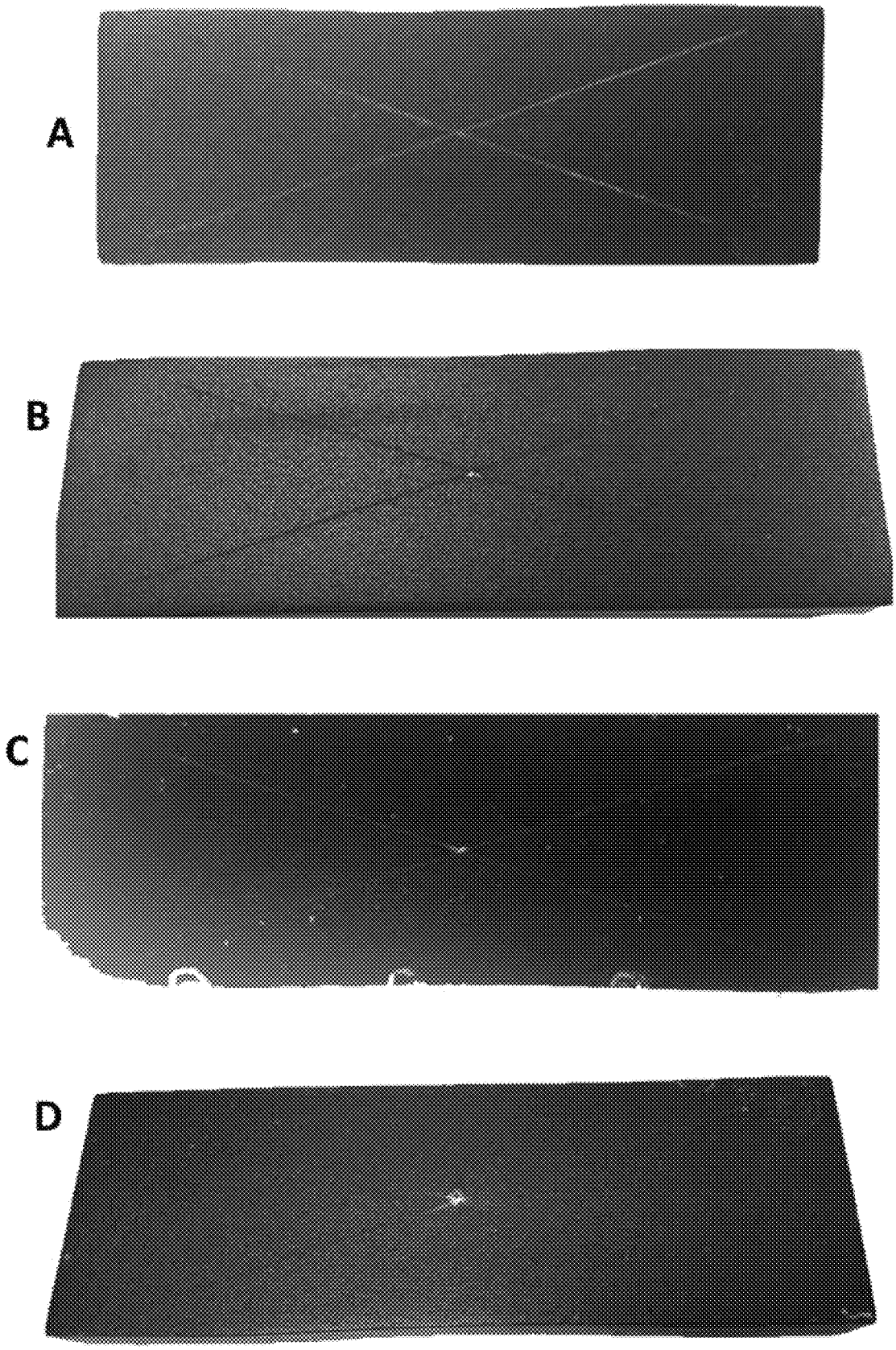
FIG. 2 represents four pictures of a same sample after different times of salt spray test according to a preferred embodiment of the invention: A (500 h), B (1000 h); C (1500 h) and D (2000 h)

Conclusions:

After 2000 hours of salt spray testing there was no apparent damage or lifting of coating along the scribe marks (See FIG. 2). The reference Elektron® 43 alloy sample was measured with a corrosion rate of 21 mpy (mils per year) after 2000 hours in salt spray environment.

Figure 3:
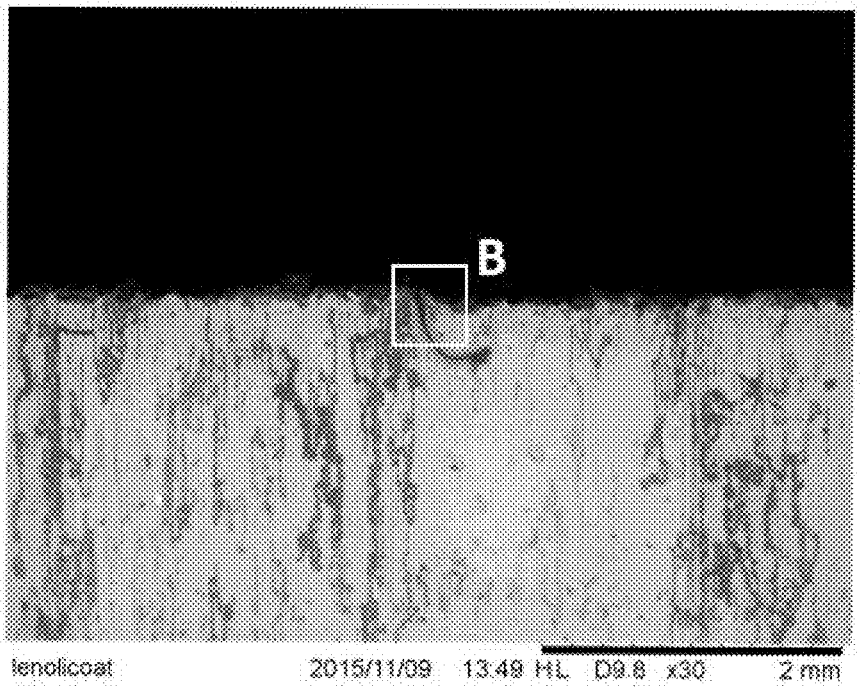
FIG. 3 represents two SEM pictures of a non-ferrous part after treatment according to a preferred embodiment of the invention: A (amplification: ×30); B (amplification: ×500)
Figure 3:
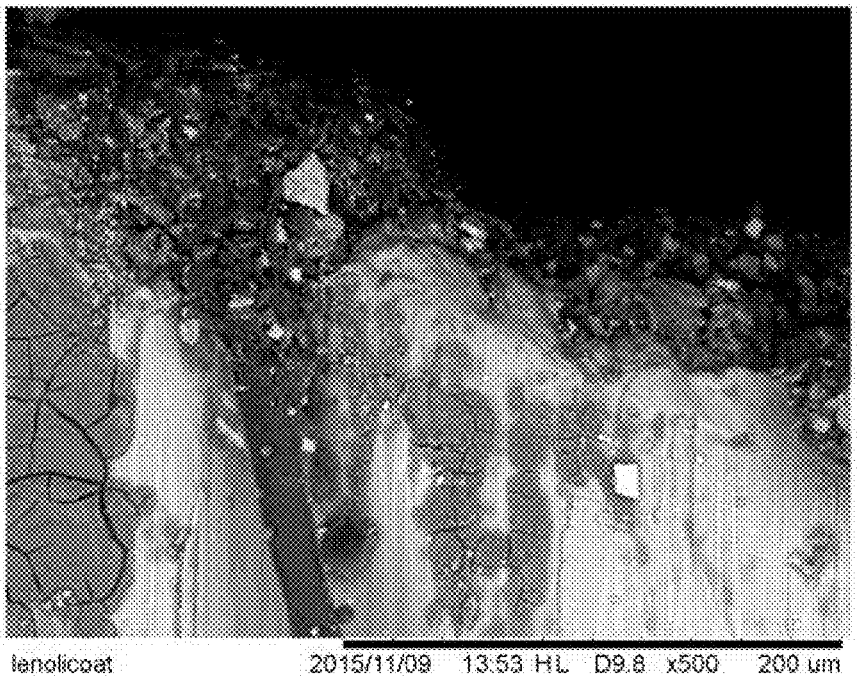
Figure 4:
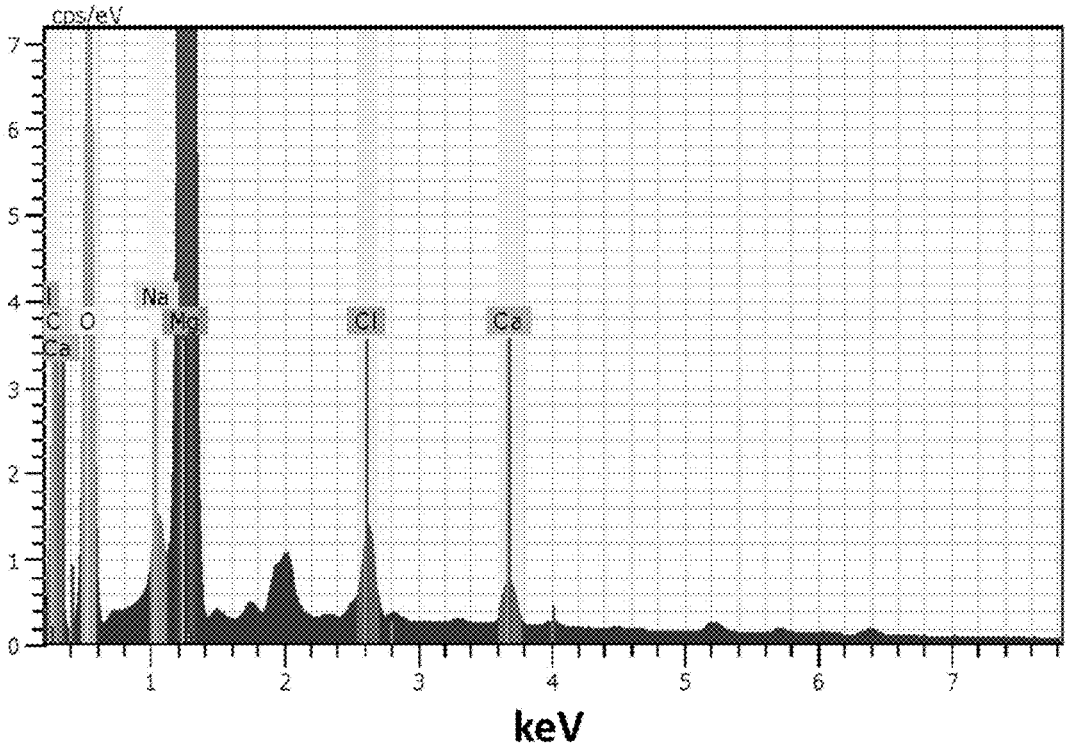
FIG. 4 is a chemical analysis of a coating on magnesium according to a preferred embodiment of the invention.

As shown in FIG. 3, the SEM analysis shows good adherence between the coating and the metal substrate as a result of the absence of pores/voids under the coating or corrosion surrounding the scribe mark.

As shown in FIG. 3, the compositional analysis also shows the absence of any significant impurities in the coating or the magnesium.

Anodization Anod SweetMag™—Alloy 6061-T6

Figure 10A:
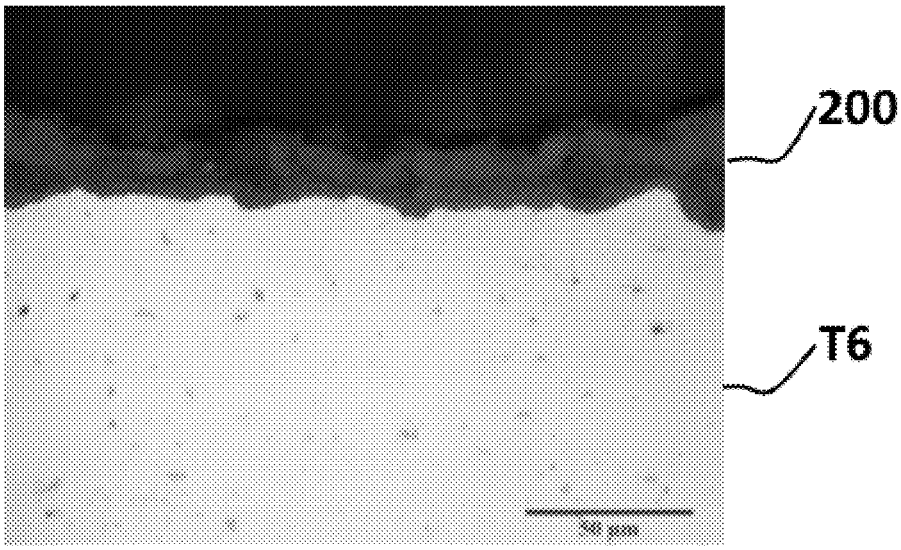
FIGS. 10A and 10B show optic metallography of the anodized coating layer of alloy 6061-T6 according to two different scales: 500 times (FIG. 10A) and 1000 times (FIG. 10B)
Figure 10B:
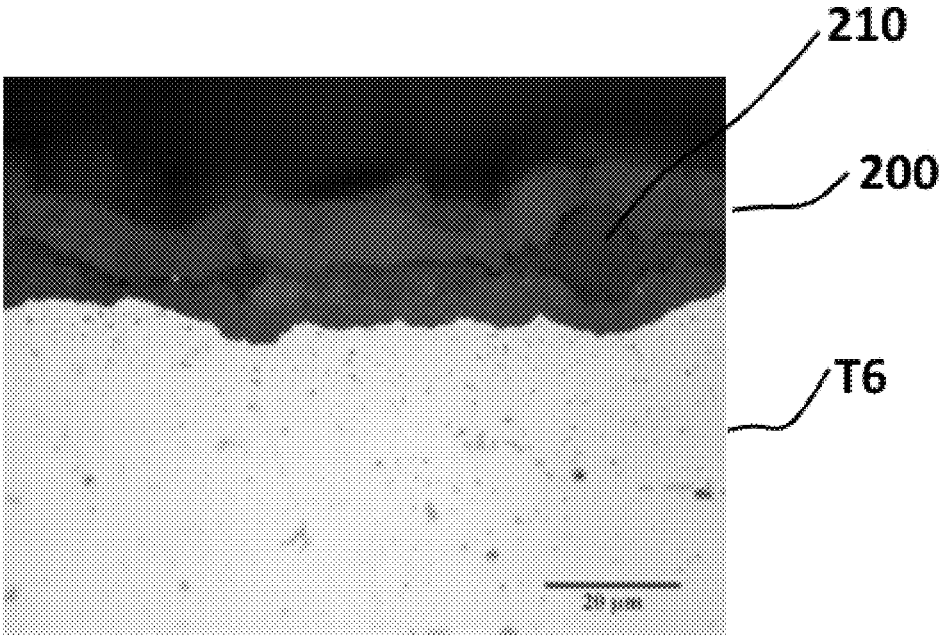

FIGS. 10A and 10B show optic metallography of an anodized coating layer of alloy 6061-T6 according to two different scales: 500 times (FIG. 10A) and 1000 times (FIG. 10B). These results show a dense interface (100) and a uniform surface (200) presenting some pores (210).

| | Core hardness | | |
|---|---|---|---|
| | 113 | 115 | 113 |
| Anodized coating layer hardness ($HV_{10gf}$) | 2924<br>1684 | 2924<br>1645 | 1794<br>2695 |

Figure 11:
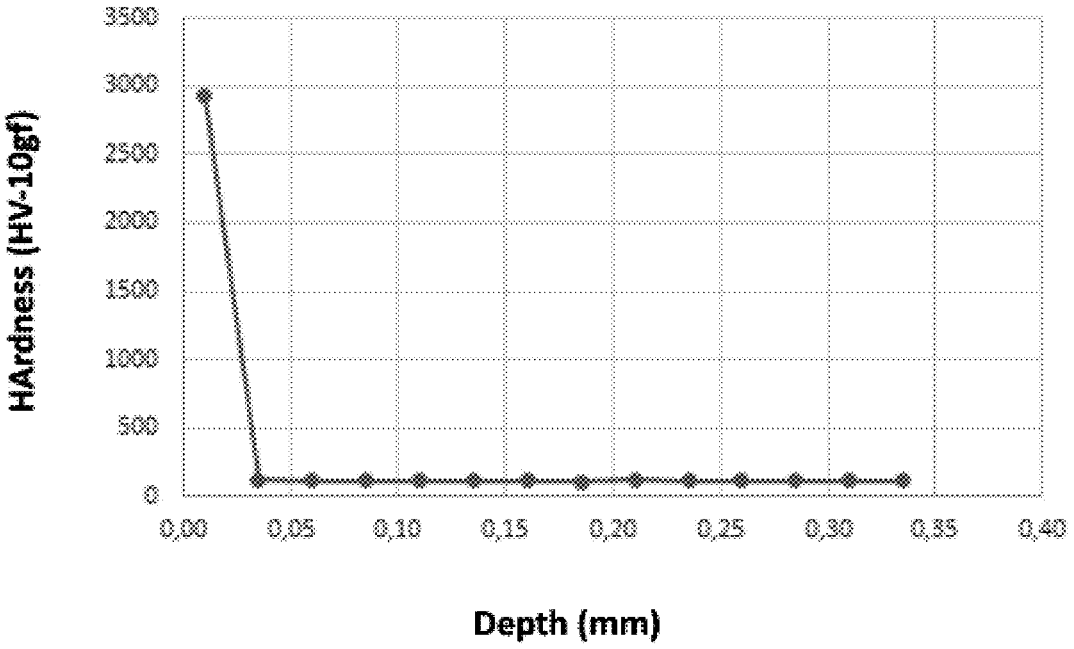
FIG. 11 is a graphic showing hardness versus depth of the layer for the anodized coating layer of alloy 6061-T6 shown in FIG. 10.

As shown above and on FIG. 11, the layer has a hardness of about 2900 HV10gf and the aluminum does not show a loss in hardness at the surface. The anodization does not affect the 6061-T6.

Indicative Post Treatment to the Proposed Electrolytic Process:

1. Rinsing the parts in tap water (several water tanks are illustrated on FIG. 1);
2. Rinsing the parts in deionized or distilled water;
3. Dipping the parts in hot water (60-100° C.) for 5 to 30 min. For metals like aluminum, this process is named "sealing" and can even last 1 to 3 minutes per micrometer of the formed layer. Any of the sealing processes used, as praxis; in the conventional sulfuric acid anodizing can be successfully applied even to the present process, because it is just considered as an alkaline anodizing process;
4. Additional treatments can be applied after the hot water dipping to improve the corrosion resistance or the aesthetic aspect of the parts, especially on magnesium or cast aluminum, and they can be as follow:

The film formed on aluminum and magnesium parts are slightly porous and can be colored by dipping the parts in organic die-stuffs solutions, similar to those used for sulfuric acid based anodized aluminum;

Painting, with one or more coatings, with any conventional process: powder, liquid or electrophoretic (known as E-coat, typical in the automotive field);

Vacuum plating deposition or coating, using any of the conventional methods known generically as CVD (Chemical Vapor Deposition), PVD (Plasma Vapor Deposition) in their different forms, and "sputtering" deposition;

Some specific deposition, like in dentistry for titanium, or in bio applications for magnesium, for its use for stents or bio absorbable prostheses.

Heat Transfer Properties of Anodized Magnesium

In order to demonstrate the importance of anodizing non-ferrous metallic parts versus non-anodized parts, an experiment has been performed on magnesium cups containing hot liquid (about 55° C. and more).

Figure 5:
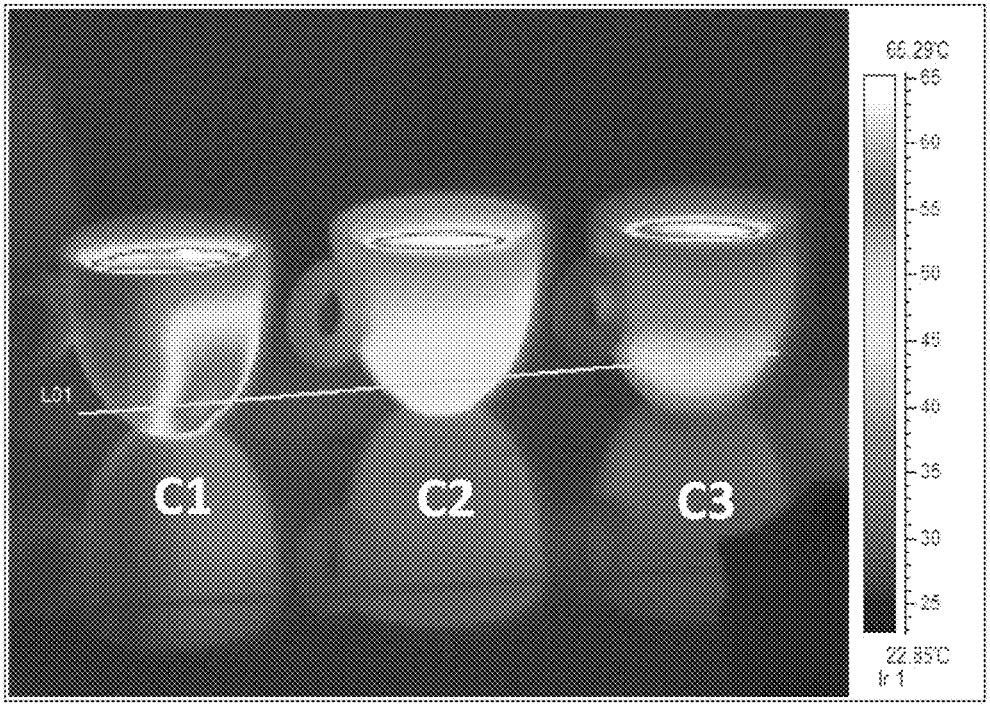
FIG. 5 is an infrared red transmission picture (A) and the corresponding diagram of temperatures (B) for a magnesium cup with no treatment (C1), for a magnesium cup anodized in accordance with the process of the present invention (C2) and a ceramic cup (C3)
Figure 5:
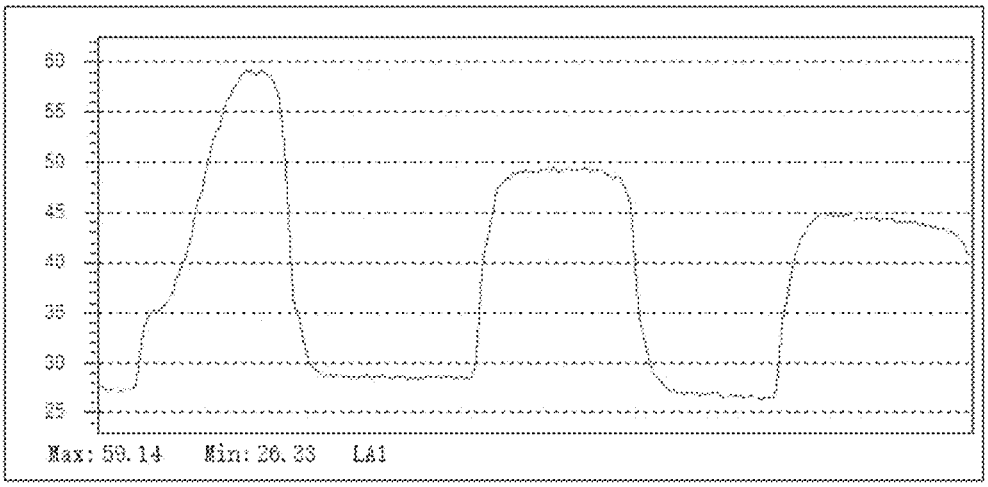

FIG. 5 is an infrared red transmission picture (A) and the corresponding diagram of temperatures (B) for a magnesium cup with no anodizing treatment (C1), for a magnesium cup anodized in accordance with the process of the present invention (C2) and a ceramic cup (C3) for reference.

For the non-treated cup (C1), the spot effect is due to a coating applied to remove the reflectivity of bare magnesium. Accordingly, in the absence of coating (C1), the entire cup would be cold (except for the spot effect). With the coating (C2), the heat transfer would be visible on almost the entire cup (about 45° C.), comparable with the ceramic cup (C3) where the bottom of the cup shows a heat transfer of about 43° C.

In conclusion, the anodization of non-ferrous metallic parts allows a better and uniform heat transfer and heat dissipation, which can be a property of major importance in the making of mechanical components of engines (aircrafts, vehicles or the like) using of these anodized parts.

Some Advantages of Using the Present Invention:

The process according to the present invention does not involve the use of toxic elements and thus the production of harmful effluents or wastes;

The electrolytic solution has a very long life and such life can be extended by adding fresh components to maintain their initial concentrations;

The process does not need any mechanical or chemical preliminary treatment, generating a significant time and money savings because as mentioned above, the chemistry of those processes usually includes toxic chemicals requiring specific processes for the treatment and disposal of the wastes;

Compared to the prior art, the electrolytic process is carried on at lower current density and voltage, generating a significant money saving;

The same electrolytic solution can be used for a lot of different metals, reducing the complexity of the layout of the industrial plant; and Subsequent finishing steps can confer special aesthetic or functional characteristics.

While illustrative and presently preferred embodiment(s) of the invention have been described in detail hereinabove, it is to be understood that the inventive concepts may be otherwise variously embodied and employed and that the appended claims are intended to be construed to include such variations except insofar as limited by the prior art.

What is claimed is:

1. An electrolytic process for anodizing non-ferrous metallic parts, the process comprising the step of:

anodizing the non-ferrous metallic parts by first applying a negative electric current to the non-ferrous metallic parts during a first given period of time and second applying a positive electric current during a second given period of time, while maintaining the non-ferrous metallic parts in an electrolytic cell comprising an alkaline electrolytic solution having a pH from 9 to 12 and comprising at least one organic acid or salt thereof;

wherein the process is performed by using a continuous current or a variously shaped pulsating current provided via a rectifier operatively connected to a harmonic filter, the harmonic filter is an Advanced Universal Harmonic Filter (AUHF) providing reduced current distortion on a source side, the AUHF allowing reducing ripple voltage while improving purity of a DC voltage used in the process.

2. The process of claim 1, wherein the pH of the alkaline electrolytic solution is from 10.5 to 11.5.

3. The process of claim 1, wherein the process is free of chemical preliminary treatment before said electrolytic treatment.

4. The process of claim 1, wherein the non-ferrous metallic parts comprises aluminum, magnesium, hafnium, tantalum, titanium, vanadium, zirconium, beryllium, scandium, yttrium, molybdenum, tungsten, alloys thereof or combinations thereof.

5. The process of claim 1, wherein the negative current is applied for up to 10 minutes, and the positive current is applied from 30 seconds to 60 minutes.

6. The process of claim 5, wherein the negative current is applied for up to 2 minutes.

7. The process of claim 1, wherein the negative current has a current density of 0.5 to 5.0 $A/dm^2$, and the positive current has a current density of 1 to 6 $A/dm^2$.

8. The process of claim 1, wherein the positive current has a voltage from 200 to 600 Volts.

9. The process of claim 1, wherein the electrolytic solution is maintained at a temperature ranging between 15 and 20° C.

10. The process of claim 1, where the said at least one organic acid, or its salts, is present in a concentration of 0.1 g/l up to solubility.

11. The process of claim 1, where the said at least one organic acid, or its salts, is present in a concentration of 0.5 to 2 g/l.

12. The process of claim 1, wherein the said at least one organic acid is carbonic acid, formic acid, acetic acid, hydroxyacetic acid, oxalic acid, citric acid, or ascorbic acid, or its salts obtained by the addition of alkali metals hydroxides or ammonium hydroxide in the solution.

13. The process of claim 1, wherein the pH is obtained by the addition in the solution of at least one alkali metal hydroxide selected from lithium, sodium and potassium, or ammonium hydroxide ($NH_4OH$).

14. The process of claim 1, wherein the electrolytic solution further comprises a metallic salt to provide electric conductivity to a coating layer formed on a surface of the non-ferrous parts during the process.

15. The process of claim 14, comprising up to about 2 g/l of AgF as the metallic salt.

16. An electrolytic process for anodizing non-ferrous metallic parts, the process comprising the steps of:

immersing the non-ferrous metallic parts in an electrolytic cell comprising an alkaline electrolytic solution having a pH from 9 to 12 and comprising at least one organic acid; and firstly applying a negative electric current to the non-ferrous metallic parts during a first given period of time for cleaning and activating the non-ferrous metallic parts; and secondly applying a positive electric current during a second given period of time for anodizing the non-ferrous metallic parts;

wherein the process is performed by using a continuous current or a variously shaped pulsating current provided via a rectifier operatively connected to a harmonic filter, the harmonic filter is an Advanced Universal Harmonic Filter (AUHF) providing reduced current distortion on a source side, the AUHF allowing reducing ripple voltage while improving purity of a DC voltage used in the process.

17. The process of claim 16, wherein the pH of the alkaline electrolytic solution is from 10.5 to 11.5.

18. The process of claim 16, wherein the process is free of chemical preliminary treatment before said electrolytic treatment.

* * * * *